US011101599B2

(12) United States Patent
Plate et al.

(10) Patent No.: US 11,101,599 B2
(45) Date of Patent: Aug. 24, 2021

(54) PLUG CONNECTOR ASSEMBLY

(71) Applicant: Kostal Kontakt Systeme GmbH, Luedenscheid (DE)

(72) Inventors: Herbert Plate, Luedenscheid (DE); Manuel Blauscheck, Herscheid (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 16/895,268

(22) Filed: Jun. 8, 2020

(65) Prior Publication Data

US 2020/0303875 A1 Sep. 24, 2020

Related U.S. Application Data

(63) Continuation of application No. PCT/EP2019/050649, filed on Jan. 11, 2019.

(30) Foreign Application Priority Data

Jan. 12, 2018 (DE) ..... 10 2018 000 207.2

(51) Int. Cl.
*H01R 13/627* (2006.01)
*H01R 12/51* (2011.01)
*H01R 12/71* (2011.01)

(52) U.S. Cl.
CPC ..... *H01R 13/6273* (2013.01); *H01R 12/51* (2013.01); *H01R 12/712* (2013.01)

(58) Field of Classification Search
CPC .... H01R 12/707; H01R 12/716; H01R 12/79; H01R 13/112; H01R 13/6275; H01R 13/641; H01R 13/7031; H01R 29/00
See application file for complete search history.

(56) References Cited

U.S. PATENT DOCUMENTS 4,907,987 A 3/1990 Douty et al.
5,232,379 A * 8/1993 Lai ..... H01R 12/57 248/222.12

(Continued)

FOREIGN PATENT DOCUMENTS

CN 2543234 Y 4/2003
CN 2599807 Y 1/2004

(Continued)

OTHER PUBLICATIONS

European Patent Office, International Search Report for corresponding International Application No. PCT/EP2019/050649, dated Mar. 13, 2019.

(Continued)

*Primary Examiner* — Edwin A. Leon
*Assistant Examiner* — Matthew T Dzierzynski
(74) *Attorney, Agent, or Firm* — Brooks Kushman P.C.

(57) ABSTRACT

A plug connector assembly includes a first plug connector part arranged on a printed circuit board (PCB) and a second plug connector part. Stamped/bent parts are positioned next to respective sides of the first plug connector part and are fastened to the PCB. In one variation, each stamped/bent part forms a spring arm, and when the plug connector parts are connected, end sections of the spring arms engage in respective detent recesses (or notches) in a base body of the second plug connector part thereby fixing the plug connector parts together. In another variation, each stamped/bent part has a detent recess, and a base body of the second plug connector part has spring arms on respective sides of the base body which lock with the detent recesses in the stamped/bent parts when the plug connector parts are connected thereby fixing the plug connector parts together.

14 Claims, 3 Drawing Sheets

(56) References Cited

U.S. PATENT DOCUMENTS

| | | | | |
|---|---|---|---|---|
| 5,354,214 | A * | 10/1994 | Aso | H01R 12/79 439/492 |
| 5,533,908 | A * | 7/1996 | Henry | H01R 13/6275 439/329 |
| 6,276,958 | B1 * | 8/2001 | Chih | H01R 12/7047 439/357 |
| 6,315,603 | B1 * | 11/2001 | Miura | H01R 12/774 439/260 |
| 6,638,106 | B1 | 10/2003 | Wu | |
| 6,971,901 | B2 * | 12/2005 | Chiu | H01R 12/79 439/329 |
| 8,535,087 | B1 | 9/2013 | McKee et al. | |
| 8,845,339 | B2 | 9/2014 | Ono | |
| 9,281,634 | B2 * | 3/2016 | Katayanagi | H01R 29/00 |
| 9,985,366 | B2 * | 5/2018 | Takeuchi | H01R 12/00 |
| 2002/0045367 | A1 | 4/2002 | Inoue | |
| 2003/0119366 | A1 | 6/2003 | Wu | |
| 2016/0036149 | A1 * | 2/2016 | Tsubo | H01R 13/502 439/374 |

FOREIGN PATENT DOCUMENTS

| | | | |
|---|---|---|---|
| DE | 10243407 | A1 | 4/2004 |
| EP | 1198031 | A2 | 4/2002 |
| JP | 2003059589 | A | 2/2003 |
| WO | 2008150523 | A2 | 12/2008 |

OTHER PUBLICATIONS

German Patent and Trademark Office, German Search Report for corresponding German Patent Application No. 10 2018 000 207.2, dated Aug. 29, 2018.

The State Intellectual Property Office of People's Republic of China, China Search Report for corresponding Chinese Patent Application No. 2019800069474 dated Jun. 28, 2020.

The International Bureau of WIPO, International Preliminary Report on Patentability for International Application No. PCT/EP2019/050649, dated Jul. 14, 2020.

The State Intellectual Property Office of People's Republic of China, The First Office Action for Chinese Patent Application No. 201980006947.4 dated Apr. 2, 2021.

The State Intellectual Property Office of People's Republic of China, The Machine English Language Translation of the First Office Action for Chinese Patent Application No. 201980006947.4 dated Apr. 2, 2021.

* cited by examiner

Fig. 3
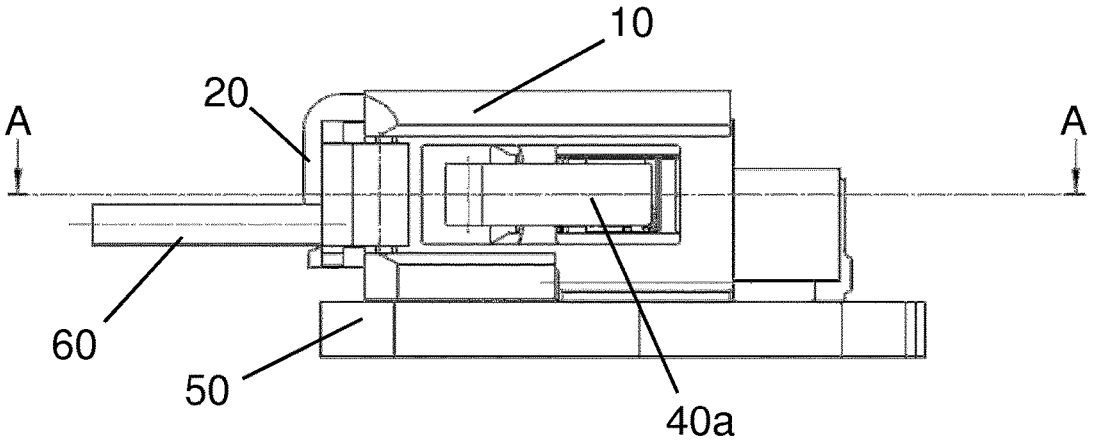
Fig. 4 A - A
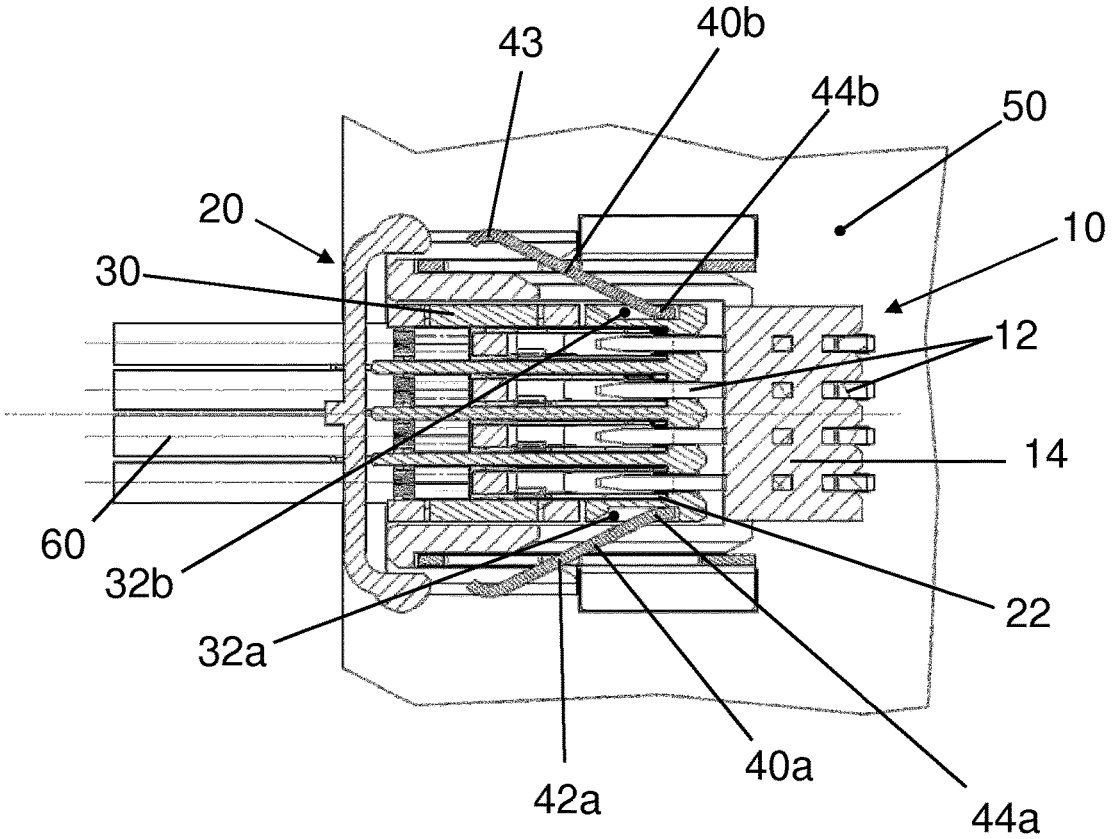

PLUG CONNECTOR ASSEMBLY

CROSS-REFERENCE TO RELATED APPLICATIONS

This application is a continuation of International Application No. PCT/EP2019/050649, published in German, with an International filing date of filed Jan. 11, 2019, which claims priority to DE 10 2018 000 207.2, filed Jan. 12, 2018; the disclosures of which are hereby incorporated in their entirety by reference herein.

TECHNICAL FIELD

The present invention relates to a plug connector assembly having first and second plug connector parts, the first plug connector part situated on a printed circuit board and including first contact elements, the second plug connector part including a base body and second contact elements held by the base body, the second plug connector part being connectable to the first plug connector part, and the second contact elements being electrically and mechanically connected to the first contact elements when the first and second plug connector parts are connected.

BACKGROUND

Such plug connector assemblies are known in many designs. The first contact elements of the first plug connector part are often connected electrically as well as mechanically to the printed circuit board. This connection of the first contact elements to the printed circuit board may be achieved, for example, by inserting end sections of the first contact elements into recesses in the printed circuit board and subsequently soldering the end sections to printed conductors of the printed circuit board.

In such plug connector assemblies, the first plug connector part must be connectable to the second plug connector part in a simple and functionally reliable manner. In particular, it should be possible to reliably prevent the two plug connector parts from being inadvertently disconnected. For this purpose, locking elements are known which are implemented, for example, by displaceable housing parts of the plug connector parts. Manufacture of these locking elements may be relatively complicated, depending on the design of the housing parts.

SUMMARY

An object is to provide a plug connector assembly having a first plug connector part arranged on a printed circuit board and a second plug connector part in which the second plug connector part is easily lockable to the first plug connector part.

At least one of the above and/or other objects is achieved, firstly, in that a pair of stamped/bent parts are positioned next to respective sides of the first plug connector part and are fastened to the printed circuit board, each stamped/bent part forms a spring arm that is movable in one-piece in parallel to the surface of the printed circuit board, and when the plug connector parts are connected, an end section of each spring arm engages in respective detent recesses (or notches) in a base body of the second plug connector part.

At least one of the above and/or other objects is achieved, secondly, in that a pair of stamped/bent part are positioned next to respective sides of the first connector part and are fastened to the printed circuit board, each stamped/bent part has a detent recess (or notch), and a base body of the second plug connector part has spring arms, integrally formed or situated on respective sides of the base body, which lock with the detent recesses in the stamped/bent parts when the plug connector parts are completely connected.

In carrying out at least one of the above and/or other objects, a plug connector assembly is provided. The plug connector assembly includes a printed circuit board, a first plug connector part, a second plug connector part, a first stamped/bent part, and a second stamped/bent part. The first plug connector part is connected to the printed circuit board and includes first contact elements. The second plug connector part includes a base body and second contact elements held by the base body. The plug connector parts are connectable together. The first and second contact elements are connected together when the first and second plug connector parts are connected together. The first and second stamped/bent parts are respectively positioned next to respective sides of the first plug connector part and are fastened to the printed circuit board.

In a "firstly" variation, the base body has first and second detent recesses on respective sides of the base body and the first and second stamped/bent parts form respective first and second spring arms that are each movable as one piece in parallel to the printed circuit board. When the first and second plug connector parts are connected together, end sections of the first and second spring arms respectively engage in the first and second detent recesses of the base body thereby fixing the second plug connector part relative to the printed circuit board and thus also fixing the second plug connector part relative to the first plug connector part.

In a "secondly" variation, the first and second stamped/bent parts have first and second detent recesses, respectively, and the base body has first and second spring arms on respective sides of the base body. The first and second spring arms respectively lock with the first and second detent recesses of the stamped/bent parts when the first and second plug connector parts are connected together thereby fixing the second plug connector part relative to the printed circuit board and thus also fixing the second plug connector part relative to the first plug connector part.

Embodiments of the present invention provide a plug connector assembly having a first plug connector part, a second plug connector part, a printed circuit board, a first stamped/bent part, and a second stamped/bent part. The first plug connector part is arranged on (i.e., connected to) the printed circuit board. The first plug connector part includes a contact carrier and first contact elements (e.g., plug contacts) held by the contact carrier. The second plug connector part includes a base body and second contact elements (e.g., sleeves) held by the base body. The stamped/bent parts are positioned next to respective sides of the first plug connector part and are fastened to the printed circuit board. The first and second plug connector parts are connectable together. The second contact elements electrically and mechanically connect to the first contact elements when the plug connector parts are connected together. Mechanical latching connections are established between the second plug connector part and the stamped/bent parts by means of spring (or resilient) arms when the plug connector parts are connected together.

Thus, in embodiments of the present invention, stamped/bent (or punched and bent) parts are fastened to the printed circuit board and the stamped/bent parts may establish mechanical detent connections to the second plug connector part via spring arms, thus fixing the second plug connector part relative to the printed circuit board and thus also relative to the first plug connector part.

The spring arms may be either integrally formed (or molded) on the stamped/bent parts or integrally formed or situated on the base body of the second plug connector part. The associated detent recesses may be provided either on the base body or on the stamped/bent parts. The above "secondly" approach according to embodiments of the present invention represents a kinematic reversal or converse of the above "firstly" approach according to embodiments of the present invention, and vice versa.

Herein, the term "stamped/bent part" is to be understood in a broad sense as a sheet metal part formed by stamping, and that has at least one section bent at a right angle or approximately a right angle. It is irrelevant whether the bending takes place at the same time as the stamping or in a subsequent work step.

The fastening of the stamped/bent parts to the printed circuit board may take place via press-fit zones, for example, which are integrally formed on bent (or angled-on) fastening strips of the stamped/bent parts. The fastening strips preferably form simple soldering surfaces that are soldered to contact surfaces or printed conductors on the surface of the printed circuit board.

The fastening of the base body of the second plug connector part to stamped/bent parts situated on the printed circuit board via spring arms, which establish detent (or snap-in) connections with the base body of the second plug connector part, enables simple and reliable fixing of the second plug connector part to the printed circuit board, and at the same time, to the first plug connector part situated on the printed circuit board. It is advantageous that for this purpose, no detent elements are necessary on the first plug connector part.

BRIEF DESCRIPTION OF THE DRAWINGS

Two exemplary embodiments of the present invention are illustrated with reference to the drawings and explained in greater detail below. In the drawings:

FIG. 3 shows a side view of the first plug connector assembly;

FIG. 4 shows a sectional view of the first plug connector assembly;

DETAILED DESCRIPTION

Figure 1:
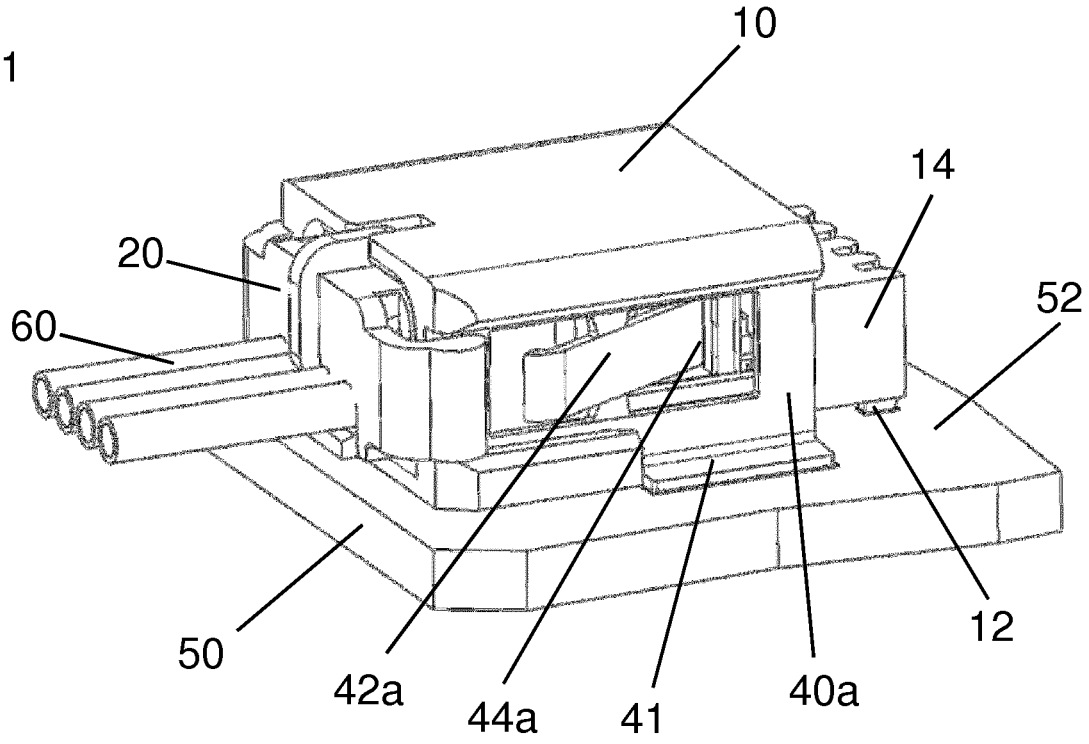
FIG. 1 shows a first plug connector assembly in accordance with a first exemplary embodiment of the present invention.
Figure 2:
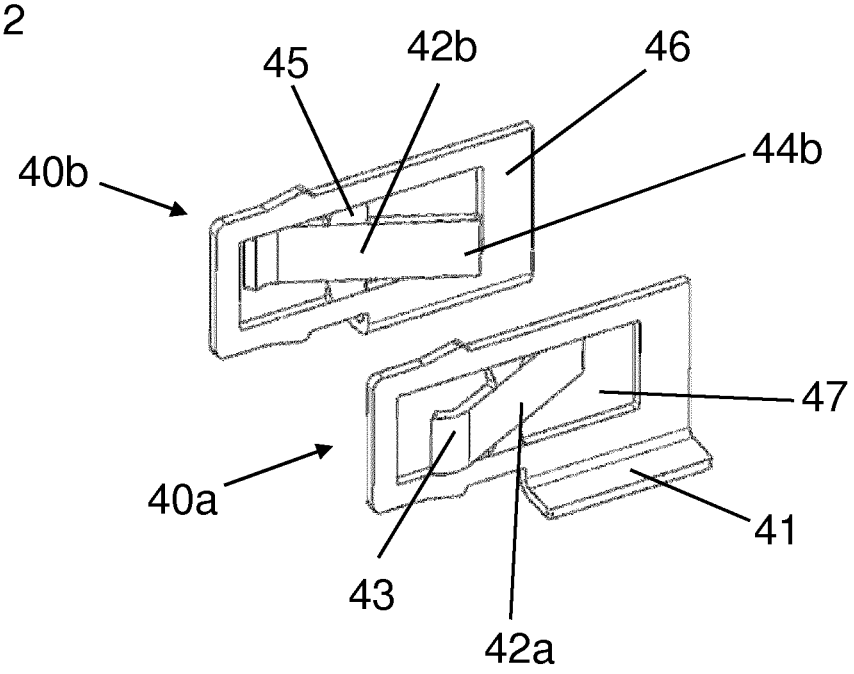
FIG. 2 shows stamped/bent parts of the first plug connector assembly.

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Referring now to FIGS. 1, 2, 3, and 4, a first plug connector assembly in accordance with a first exemplary embodiment of the present invention is shown. The first plug connector assembly includes a first plug connector part 10, a second plug connector part 20, a printed circuit board 50, a first stamped/bent part 40*a*, and a second stamped/bent part 40*b*.

First plug connector part 10 is arranged or situated on (i.e., connected to) printed circuit board 50. First plug connector part 10 includes first contact elements 12 and a contact carrier 14. First contact elements 12 are held by contact carrier 14 of first plug connector part 10. First contact elements 12 are connected electrically and mechanically to printed circuit board 50.

Second plug connector part 20 includes second contact elements 22 and a base body 30. Second contact elements 22 are held by base body 30 of second plug connector part 20.

First and second plug connector parts 10, 20 are connectable together. First and second contact elements 12, 22 are electrically and mechanically connected when first and second plug connector parts 10, 20 are connected together.

Stamped/bent parts 40*a*, 40*b* are positioned next to respective sides of first plug connector part 10. Stamped/bent parts 40*a*, 40*b* are fastened to printed circuit board 50. Stamped/bent parts 40*a*, 40*b* form respective spring arms 42*a*, 42*b*. Spring arms 42*a*, 42*b* are movable in one-piece in parallel to surface 52 of printed circuit board 50. When first and second plug connector parts 10, 20 are connected together, end sections 44*a*, 44*b* of spring arms 42*a*, 42*b* engage in respective detent recesses (or notches) 32*a*, 32*b* in base body 30 of second plug connector part 20, thus fixing second plug connector part 20 relative to printed circuit board 50 and thus also relative to first plug connector part 10.

FIG. 1 shows first plug connector part 10 situated on printed circuit board 50 and connected to second plug connector part 20. Multiple connecting lines 60, which are electrically connected to second contact elements 22 of second plug connector part 20, lead out from second plug connector part 20.

In addition to plug connector parts 10, 20, also apparent in FIG. 1 is one of two stamped/bent parts 40*a*, 40*b* that are present. Stamped/bent parts 40*a*, 40*b* are illustrated together in FIG. 2 as individual parts. The two stamped/bent parts 40*a*, 40*b* have a mirror-symmetrical design relative to one another. In each case, stamped/bent parts 40*a*, 40*b* have a vertical frame section 46 in which rectangular spring arm 42*a*, 42*b* is in each case situated in a rectangular recess 47. At its upper and lower edge, each spring arm 42*a*, 42*b* is connected to frame section 46 via a short, narrow metal strip 45, and is thus supported so that it is pivotable with respect to frame section 46. Each stamped/bent part 40*a*, 40*b* on the bottom side of its frame section 46 has a narrow fastening strip 41 that is bent at a right angle relative to frame section 46.

When the first plug connector assembly is installed, fastening strips 41 of stamped/bent parts 40*a*, 40*b* rest on surface 52 of printed circuit board 50 and are used to fasten the stamped/bent parts to the printed circuit board. For this purpose, stamped/bent parts 40*a*, 40*b*, similarly to electronic SMD (surface-mount device) components, are preferably soldered to contact surfaces or printed conductors (not shown) on surface 52 of printed circuit board 50. Alternatively, fastening strips 41 on their bottom side may have press-fit zones (not shown) and may be inserted into boreholes (not shown) in printed circuit board 50.

FIG. 3 shows a side view of the first plug connector assembly. FIG. 4 shows a sectional view A-A of FIG. 3 that identifies further details of the first plug connector assembly.

FIG. 4 shows that first contact elements 12, which are part of first plug connector part 10, are held by contact carrier 14 of the first plug connector part. Contact carrier 14 may be made of plastic. Second contact elements 20, which are part of second plug connector part 20, are held by insulating base body 30 of the second plug connector part. When first and second plug connector parts 10, 20 are connected together, which is the case in FIG. 4, front sections of first contact elements 12 are inserted into second contact elements 22. Second contact elements 22 are electrically connected to electrical connecting lines 60 that lead out of second plug connector part 20. As shown in FIG. 4, first contact elements 12 may be designed as flat plugs and second contact elements 22 may be designed as push-on sleeves.

Base body 30 of second plug connector part 20 has a detent (or latching) recess 32*a*, 32*b* on each of its two side faces, in parallel to second contact elements 22. When plug connector parts 10, 20 are connected together, as illustrated in FIGS. 1, 2, 3, and 4, respective end sections of spring arms 42*a*, 42*b* of stamped/bent parts 40*a*, 40*b*, which functionally form detent hooks 44*a*, 44*b*, are respectively deflected into detent recesses of base body 30. Since stamped/bent parts 40*a*, 40*b* are fixedly mechanically connected to printed circuit board 50, second plug connector part 20 is fixed relative to printed circuit board 50 and also relative to first plug connector part 10 via spring arms 42*a*, 42*b*.

Inadvertent disconnection of plug connector parts 10, 20 due to falling out or being pulled out via connecting lines 60 is thus prevented. Plug connector parts 10, 20 can be disconnected from one another by simultaneously exerting pressure on two actuating sections 43 of spring arms 42*a*, 42*b*, which allows detent hooks 44*a*, 44*b* to be moved out of detent recesses 32*a*, 32*b* of base body 30, against the elastic force of spring arms 42*a*, 42*b*.

Figure 5:
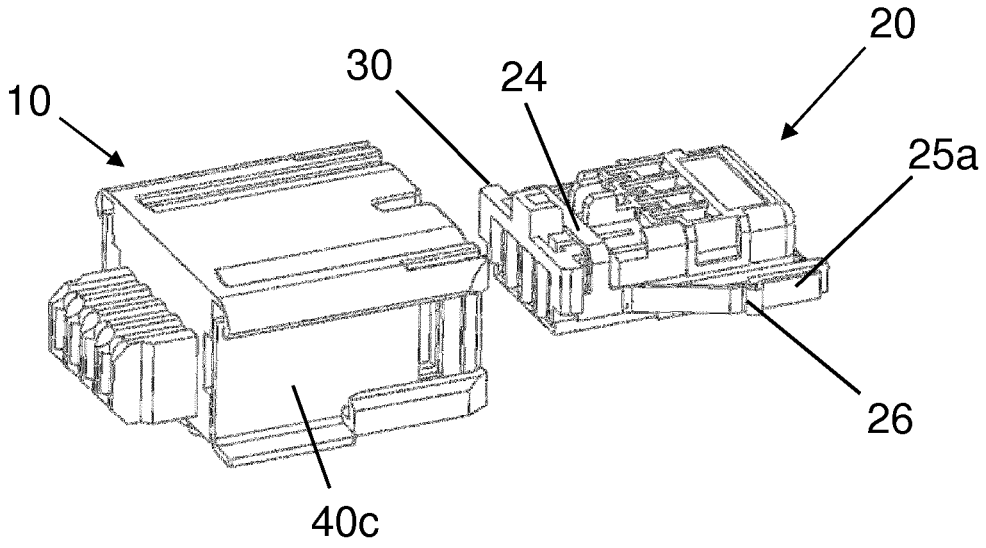
FIG. 5 shows a second plug connector assembly in accordance with a second exemplary embodiment of the present invention.
Figure 6:
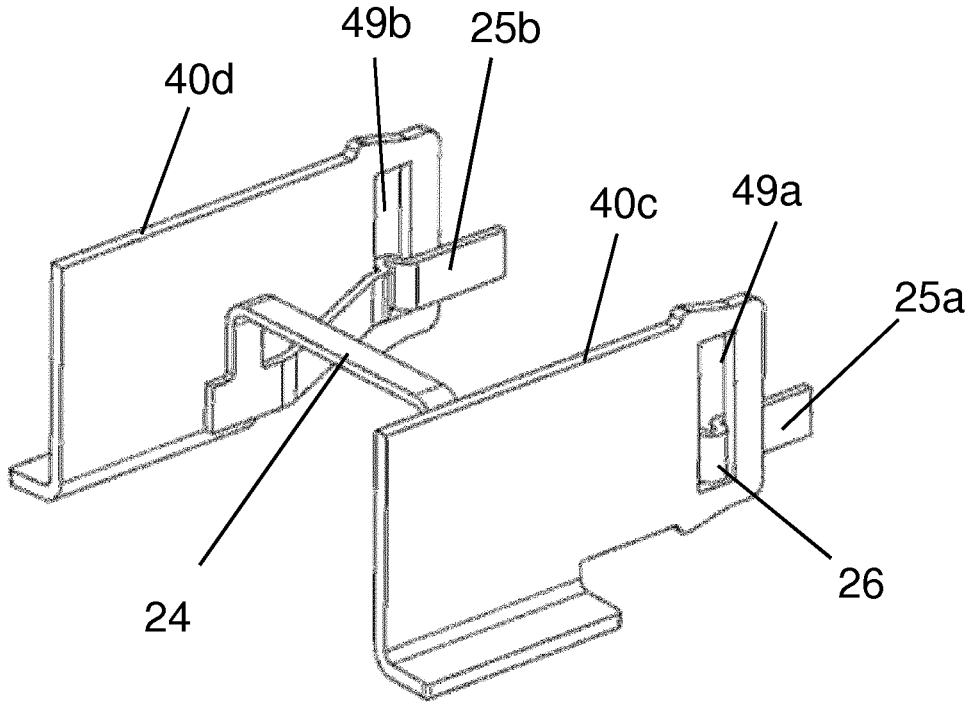
FIG. 6 shows stamped/bent parts of the second plug connector assembly.

FIGS. 5 and 6 show an alternative design of the plug connector assembly. This variant differs from the above-described design in that stamped/bent parts 40*c*, 40*d* in this case have respective detent recesses 49*a*, 49*b* instead of spring arms.

Situated on base body 30 of second plug connector part 20 is a connecting element 24. Connecting element 24 is preferably metallic. Connecting element 24 forms a U-shaped bracket which encompasses base body 30 and which has spring arms 25*a*, 25*b* that are integrally formed on the side faces of the base body. Each spring arm 25*a*, 25*b* forms a bent section 26. When plug connector parts 10, 20 are connected together, bent sections 26 engage in detent recesses 49*a*, 49*b* of stamped/bent parts 40*c*, 40*d*.

Here as well, connecting element 24 and stamped/bent parts 40*c*, 40*d* result in a mechanical connection between base body 30 of second plug connector part 20 and printed circuit board 50 (not shown), which at the same time fixes second plug connector part 20 relative to first plug connector part 10.

LIST OF REFERENCE NUMERALS

10 first plug connector part
12 first contact elements
14 contact carrier
20 second plug connector part
22 second contact elements
24 connecting element
25*a*, 25*b* spring arms
26 (bent) section
30 base body
32*a*, 32*b* detent recesses (or notches)
40*a*, 40*b*, 40*c*, 40*d* stamped/bent parts
41 fastening strip
42*a*, 42*b* spring arms
43 actuating sections
44*a*, 44*b* detent hooks (end sections)
45 metal strip
46 frame section
47 recess
49*a*, 49*b* detent recesses
50 printed circuit board
52 surface of the printed circuit board
60 electrical connecting lines While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A plug connector assembly comprising:

a printed circuit board;

a first plug connector part connected to the printed circuit board, the first plug connector part having first contact elements;

a second plug connector part having a base body and second contact elements held by the base body, the base body having first and second detent recesses on respective sides of the base body;

the first and second plug connector parts being connectable together, wherein the first and second contact elements are connected together when the first and second plug connector parts are connected together;

a first stamped/bent part and a second stamped/bent part, the first and second stamped/bent parts respectively positioned next to respective first and second sides of the first plug connector part and fastened to the printed circuit board, the first and second stamped/bent parts forming respective first and second spring arms that are each movable as one piece relative to the first and second sides of the first plug connector part, respectively, in parallel to the printed circuit board, wherein each of the first and second spring arms has an end section; and wherein the first and second plug connector parts being connected together causes the first and second spring arms to move relative to the first and second sides of the first plug connector part, respectively, in parallel to the printed circuit board resulting in the end sections of the first and second spring arms respectively engaging in the first and second detent recesses of the base body thereby fixing the second plug connector part relative to the printed circuit board and thus also fixing the second plug connector part relative to the first plug connector part.

2. The plug connector assembly according to claim 1 wherein:

the end sections of the spring arms are detent hooks.

3. The plug connector assembly according to claim 1 wherein:

the stamped/bent parts are fastened to the printed circuit board by being soldered onto the surface of the printed circuit board.

4. The plug connector assembly according to claim 1 wherein:

the stamped/bent parts have a mirror-symmetrical design relative to one another.

5. The plug connector assembly according to claim 1 wherein:

the first plug connector part further includes a contact carrier, wherein the first contact elements are held by the contact carrier.

6. The plug connector assembly according to claim 1 wherein:

the first contact elements are connected to the printed circuit board.

7. The plug connector assembly according to claim 1 wherein:

the first plug connector part is connected to the printed circuit board irrespective of the first and second stamped/bent parts.

8. The plug connector assembly according to claim 1 wherein:

each of the first and second spring arms further has an actuating section, the actuating section of each spring arm being opposite to the end section of the spring arm; and pressure being exerted on the actuating sections while the first and second plug connector parts are connected together causes the first and second spring arms to move relative to the first and second sides of the first plug connector part, respectively, in parallel to the printed circuit board resulting in the end sections of the first and second spring arms respectively disengaging from the first and second detent recesses of the base body thereby enabling the second plug connector part to be disconnected from the first plug connector part.

9. A plug connector assembly comprising:

a printed circuit board;

a first plug connector part connected to the printed circuit board, the first plug connector part having first contact elements;

a second plug connector part having a base body and second contact elements held by the base body;

the first and second plug connector parts being connectable together, wherein the first and second contact elements are connected together when the first and second plug connector parts are connected together;

a first stamped/bent part and a second stamped/bent part, the first and second stamped/bent parts respectively positioned next to respective sides of the first plug connector part and fastened to the printed circuit board, the first and second stamped/bent parts having first and second detent recesses, respectively;

the base body having first and second spring arms on respective sides of the base body which respectively lock with the first and second detent recesses of the stamped/bent parts when the first and second plug connector parts are connected together thereby fixing the second plug connector part relative to the printed circuit board and thus also fixing the second plug connector part relative to the first plug connector part; and wherein the first plug connector part is connected to the printed circuit board irrespective of the first and second stamped/bent parts.

10. The plug connector assembly according to claim 9 wherein:

the first and second spring arms have respective first and second bent sections which respectively lock with the first and second detent recesses of the stamped/bent parts.

11. The plug connector assembly according to claim 9 wherein:

the base body further includes a metallic connecting element connected between the first and second spring arms, the metallic connecting element and the first and second spring arms being integrally formed as one piece.

12. The plug connector assembly according to claim 9 wherein:

the stamped/bent parts are fastened to the printed circuit board by being soldered onto the printed circuit board.

13. The plug connector assembly according to claim 9 wherein:

the stamped/bent parts have a mirror-symmetrical design relative to one another.

14. The plug connector assembly according to claim 9 wherein:

the first contact elements are connected to the printed circuit board.

* * * * *